US007299925B1

(12) United States Patent
Ansay et al.

(10) Patent No.: US 7,299,925 B1
(45) Date of Patent: Nov. 27, 2007

(54) FLEXIBLE PAYLOAD MODULE WITH INFLATABLE GRIPPERS

(75) Inventors: Michael T. Ansay, Johnston, RI (US); Mariela I. Santiago, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 291 days.

(21) Appl. No.: 10/968,656

(22) Filed: Oct. 18, 2004

(51) Int. Cl.
*B65D 81/15* (2006.01)
*B65D 81/05* (2006.01)

(52) U.S. Cl. ..... 206/522; 206/583; 206/591

(58) Field of Classification Search ..... 206/522, 206/591–594, 583; 383/3; 410/119; 428/178
See application file for complete search history.

(56) References Cited

U.S. PATENT DOCUMENTS

| | | | | |
|---|---|---|---|---|
| 2,874,826 | A * | 2/1959 | Matthews et al. | 206/522 |
| 4,155,453 | A | 5/1979 | Ono | |
| 4,215,778 | A * | 8/1980 | Kovins | 206/522 |
| 4,762,231 | A | 8/1988 | Kiselewski | |
| 4,905,835 | A | 3/1990 | Pivert et al. | |
| 4,962,552 | A | 10/1990 | Hasty | |
| 5,000,318 | A | 3/1991 | Kupersmit | |
| 5,018,226 | A | 5/1991 | Davies et al. | |
| 5,030,501 | A * | 7/1991 | Colvin et al. | 428/178 |
| 5,099,991 | A * | 3/1992 | Kitagawa et al. | 206/522 |
| 5,217,131 | A * | 6/1993 | Andrews | 206/522 |
| 5,274,846 | A * | 1/1994 | Kolsky | 2/460 |
| 5,275,290 | A | 1/1994 | Bierfound | |
| 5,433,506 | A | 7/1995 | Jensen | |
| 5,692,607 | A * | 12/1997 | Brosmith et al. | 206/522 |
| D418,745 | S * | 1/2000 | Berger | D8/402 |
| D419,862 | S * | 2/2000 | Berger | D8/402 |
| 6,149,002 | A * | 11/2000 | Tiramani et al. | 206/592 |
| 6,154,907 | A * | 12/2000 | Cinquin | 5/713 |
| 6,682,128 | B2 * | 1/2004 | Carroll et al. | 296/187.03 |
| 2005/0284791 | A1 * | 12/2005 | Sadow | 206/522 |

* cited by examiner

*Primary Examiner*—Bryon P. Gehman
(74) *Attorney, Agent, or Firm*—James M. Kasischke; Michael P. Stanley; Jean-Paul A. Nasser

(57) ABSTRACT

A module for a payload that utilizes individual grippers in which each fill to a conical shape from an interior wall of the module toward a payload in the module. The shape of the grippers provides a holding strength on and lateral stability for the payload. The angle of the conical shape transfers the axial force of the payload into a tensional load on the gripper where it has comparatively greater strength. The conical shape of each gripper allows for more complete capture of a payload in that the grippers fill voids around the payload. Since there are more contact points with the grippers and the payload, the contact force required for an adequate capture can be spread out.

2 Claims, 9 Drawing Sheets

FLEXIBLE PAYLOAD MODULE WITH INFLATABLE GRIPPERS

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to a payload module capable of storing payloads of various shapes. The payload module utilizes a flexible material that can conform to the shape of the payload by being inflated for a gripping action on the payload.

(2) Description of the Prior Art

As a result of evolving missions and the limitations of space on naval vessels, a need exists to transport special equipment (such as motorcycles, all-terrain vehicles, jet skis, rafts, boats, etc.) using payload modules.

Presently, payload modules transport special equipment includes handling gear that is specifically designed for the equipment to be transported. Since the types of equipment or payload items may vary extensively, it is necessary to provide a flexible payload module that could be used for many items as opposed to being designed specifically for just one.

In the Ono reference (U.S. Pat. No. 4,155,453), an inflatable grip container is provided. As shown with the example camera in FIG. 3 of the reference, the container (buoyant case 1) is a broad inflatable bag that would be limited to the extending sections of the camera (or alternate payload). Since the contour of the camera is not fully covered, compartments (item 6) exist in which the camera (or alternate payload) is not securable.

In the Kieselewski reference (U.S. Pat. No. 4,762,231), a pneumatic device for holding articles in containers is provided. The container (item 12) has a mat (item 14) disposed therein. A plurality of individual inflatable members (item 20) are positioned with the mat. The members are inflated until an article placed in the container is in contact with a pressure applying surface (item 22). Similar to the inflatable bag of the Ono reference, the pressure applying surface is limited to the extending sections of a payload placed in the container. Since the contour of the payload is not fully covered, compartments would exist in which the payload is not securable.

As a result, a need exists for an improved payload system or module that utilizes individual grippers in which the inflatable or fillable grippers provide a holding strength on and lateral stability for the payload. The flexible payload module should be able to hold and provide stability for payload items of varying sizes.

SUMMARY OF THE INVENTION

It is therefore an object of the present invention to provide a payload module that utilizes individual grippers in which the grippers provide a holding strength on and lateral stability for the payload.

It is therefore a further object of the present invention to provide a flexible payload module that could be used for payload items of varying sizes.

In order to attain the objects described, there is provided a payload module that utilizes numerous inflatable fingers or grippers that are preferably conical in shape. The conical shape is unique as it allows for the contact area of the gripper to increase and decrease with the size of the payload. This change in contact area can be accomplished without having to change the pressure inside each gripper.

The conical shape of the grippers also provides an axial holding strength of the payload thereby providing a greater securing force to the payload. If a payload moves perpendicular to the longitudinal axis of the gripper, the conical shape provides for lateral stability. Specifically as an individual gripper is displaced to one side, the gripper deflects and places the material of the gripper in tension. The angle of the conical shape transfers the axial payload force into a tensional load on the gripper where it has the greatest strength.

The number of grippers along with the conical shape of each gripper allow for more complete capture of a payload in that the grippers can fill voids around the payload item. Since there are more contact points with the grippers and the payload, the contact force required for an adequate capture can be spread out.

Each of the grippers is capable of using seawater as the inflation fluid as well as consideration to a mixture of fluids or the use of different fluids in various chambers. The mixing of fluids allows for non-linear loadings such as in a non-exclusive use in which a gripper could utilize a very soft (less dense) fluid like air at its tip and a denser fluid like water at its base, or vice versa.

The grippers are made from elastomeric materials such as rubber, or non-elastomeric materials such as Kevlar. The elastomeric material provides for greater flexibility and the non-elastomeric material provides for greater strength.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
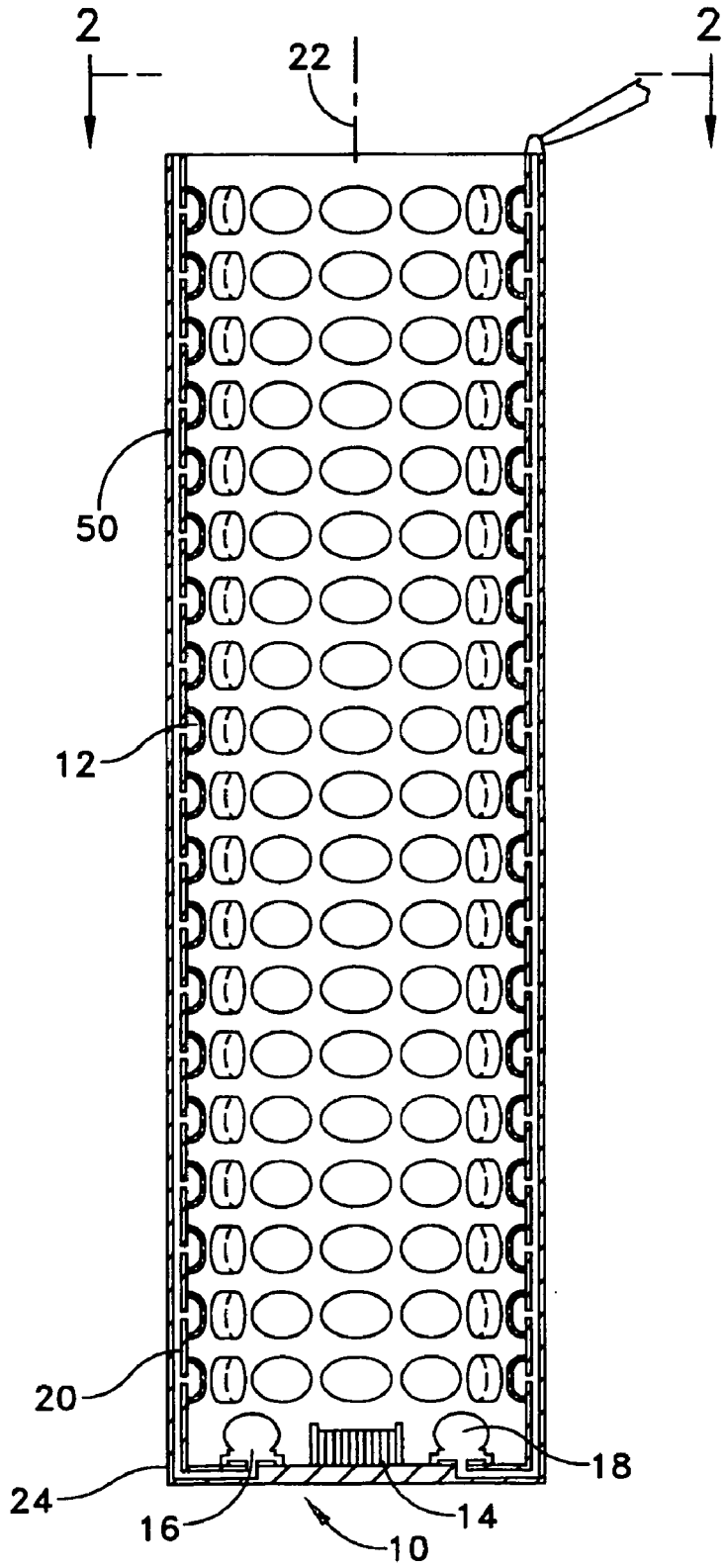
FIG. 1 depicts a cross-sectional view of a payload module of the present invention in which the flexible grippers of the payload module are deflated.

Referring now to FIG. 1 there is shown a cross-sectional view of a payload module 10 as the present invention. In the figure, the payload module 10 generally comprises a plurality of conical grippers 12 (shown non-filled or deflated), a winch assembly 14 and a pair of submersible pumps 16, 18.

Figure 2:
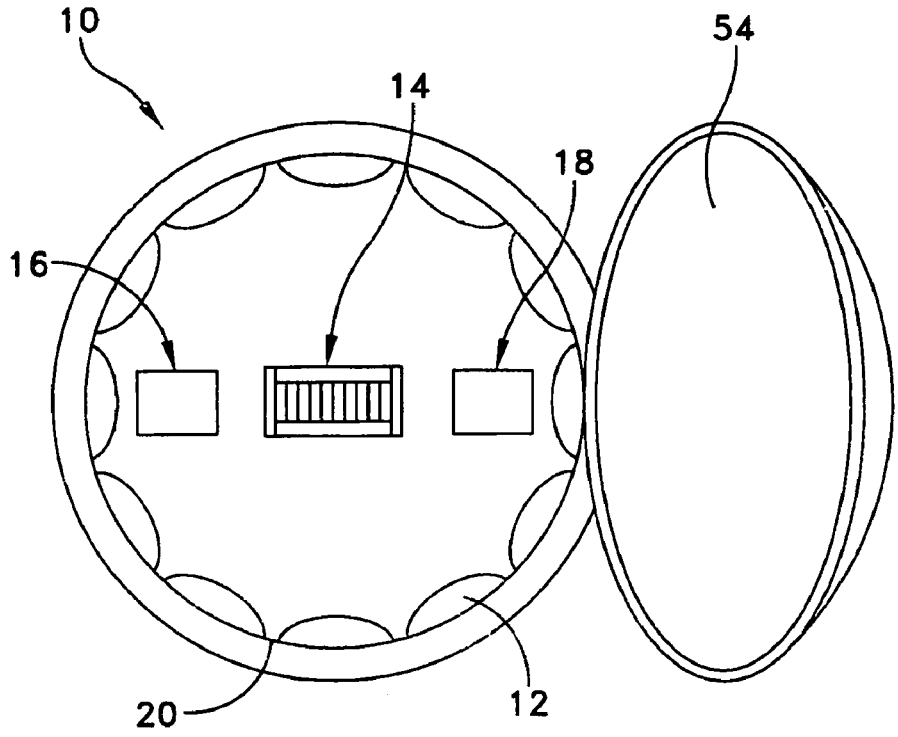
FIG. 2 depicts a plan view of the payload module of the present invention with the view taken from reference line 2-2 of FIG. 1.

As depicted in the figure and the plan view of FIG. 2, the payload module 10 includes an interior cylindrical wall 20 with several rows of the grippers 12. Each gripper 12 is made of a watertight material that can be inflated or filled and deflated with pressurized water.

Figure 3:
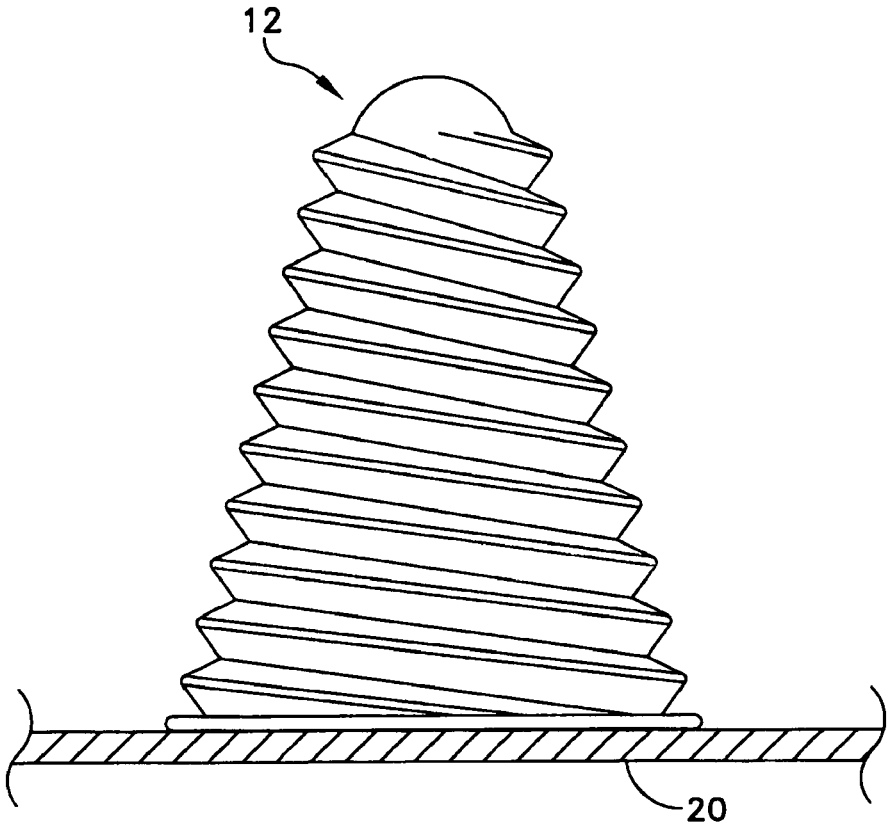
FIG. 3 depicts a side view of bellows-type gripper.

The conical shape of the grippers 12 allows the grippers to collapse within themselves as they are deflated. Because the conical shape gets progressively smaller in diameter from its base to its inner center, the gripper 12 will flatten when deflated. When made of rubber, the grippers 12 are flexible enough to be collapsed from a smooth shape into the flattened shape such that they occupy very little volume when deflated. For tougher materials, such as Kevlar, to collapse into flattened shape, the grippers can have a bellows shape as shown in FIG. 3. The flattened profile of each gripper 12 takes up a minimal amount of space, thereby providing a maximum amount of space for a given payload.

Figure 4:
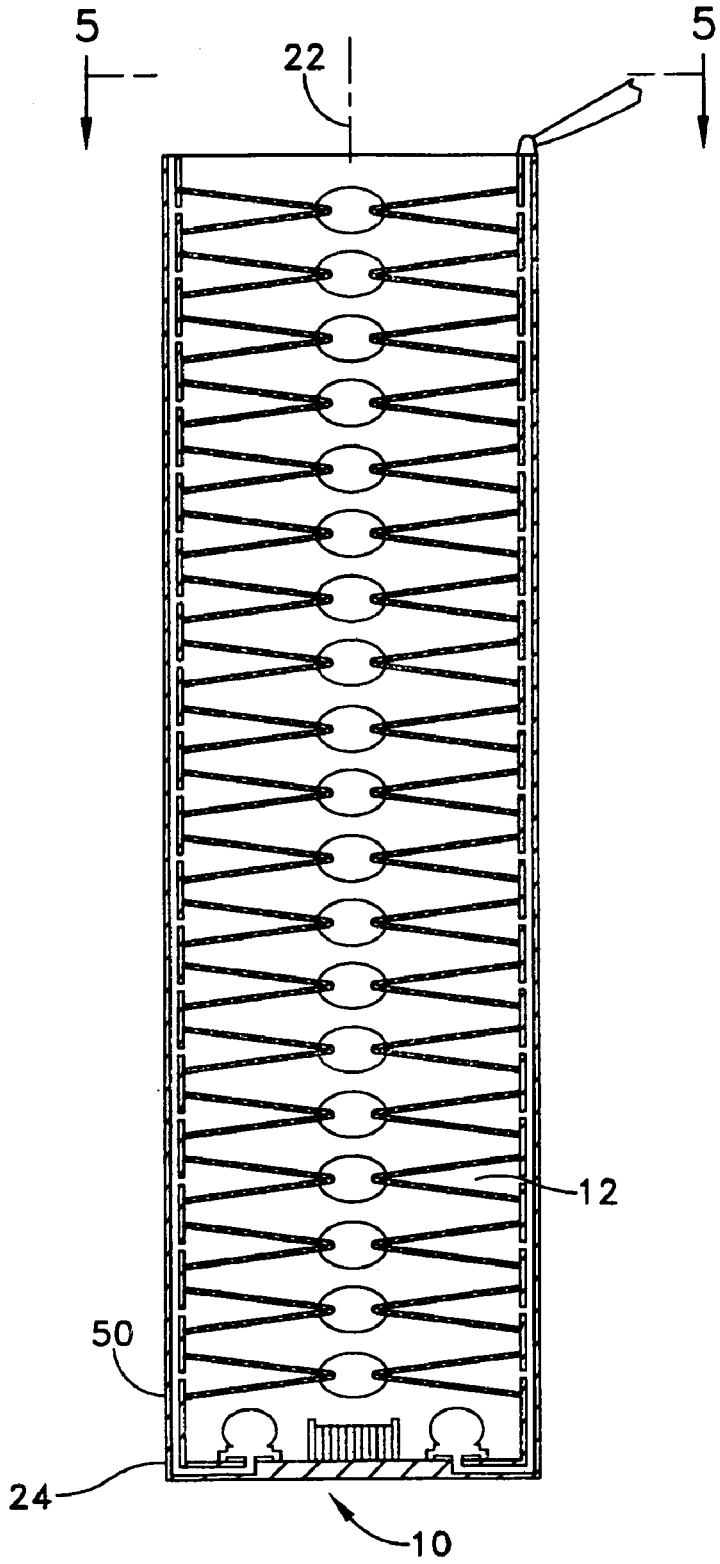
FIG. 4 depicts a cross-sectional view of a payload module of the present invention in which the flexible grippers of the payload module are filled or inflated.
Figure 5:
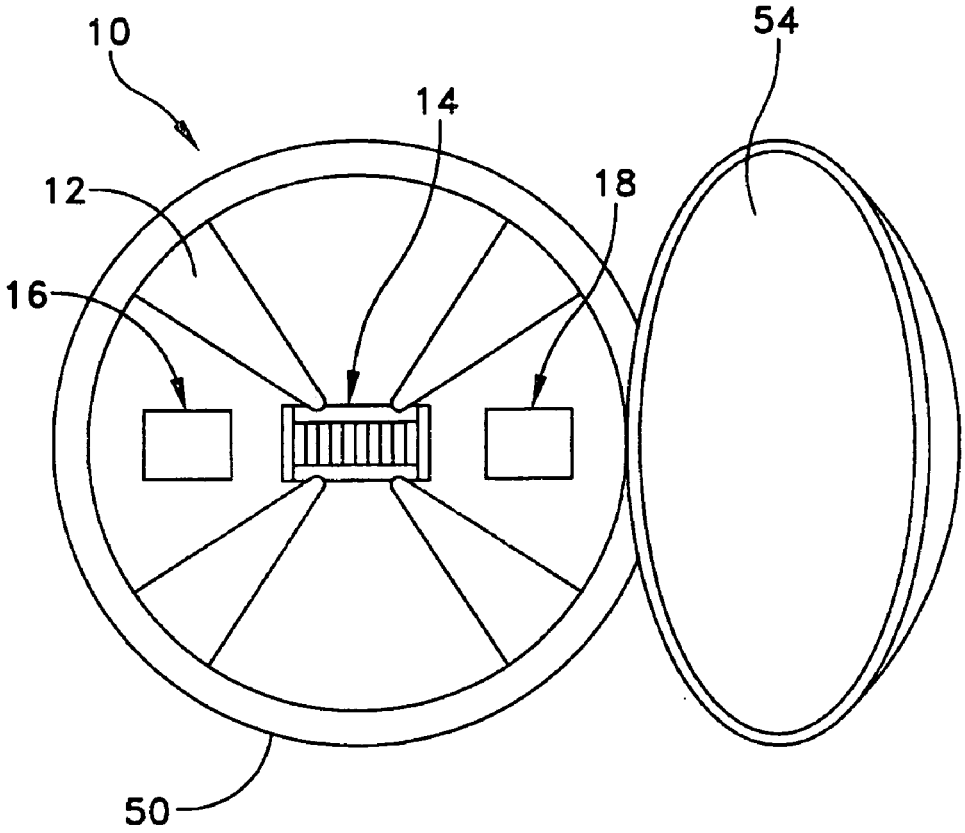
FIG. 5 depicts a plan view of the payload module of the present invention with the view taken from reference line 5-5 of FIG. 4 in which some of the flexible grippers are removed for clarity.
Figure 6:
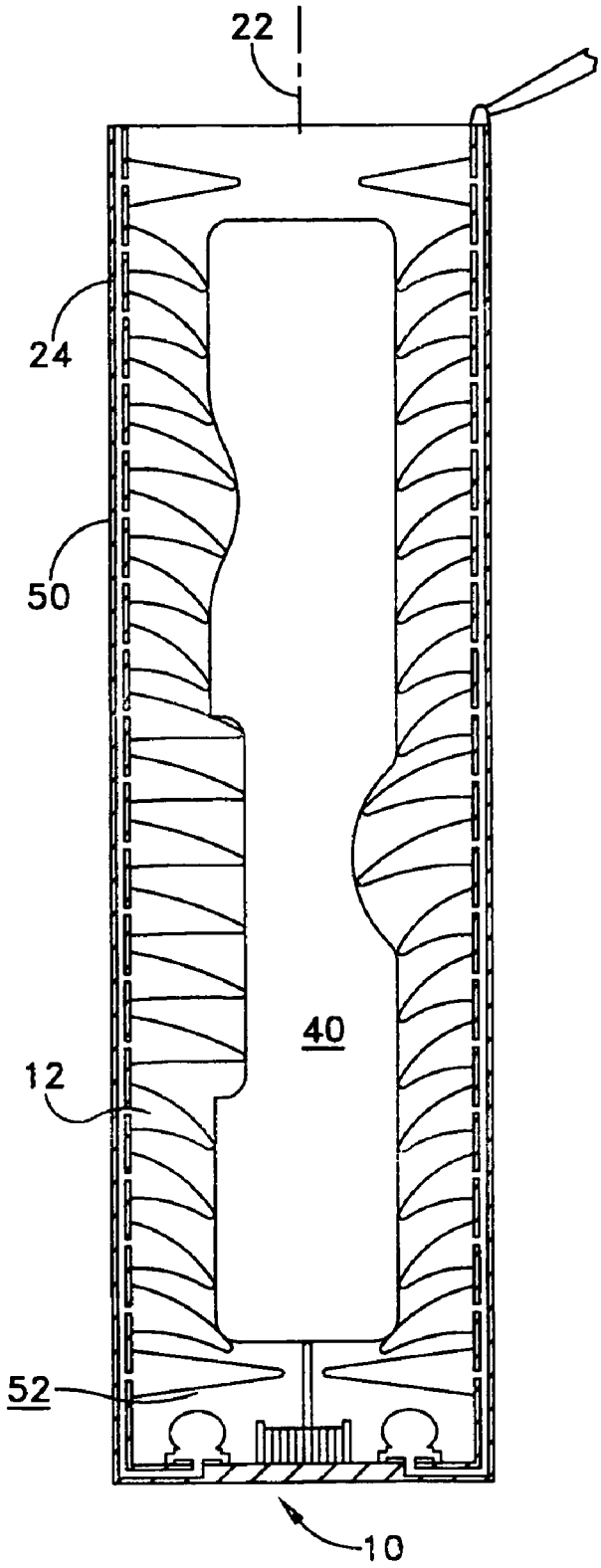
FIG. 6 depicts a cross-sectional view of a payload module of the present invention in which the flexible grippers of the payload module are filled or inflated in contact with a payload.

As shown in FIGS. 4 and 5, the grippers 12 are conical in shape so that they can expand towards a longitudinal axis 22 of the payload module 10 and a positioned payload 40 (shown in FIG. 6) without interfering with one another.

As shown in the figures, the payload module 10 is contained inside a watertight and high pressure-resistant container 50. The container 50 protects the payload module 10 and its contents from extreme depth pressures and pressure fluctuations if the container is used with a submarine or as part of other submersibles (not shown). As such, the interior of the payload module 10 remains at a steady pressure. Because the container 50 is watertight, the payload module 10 may be filled with air to keep it contents dry.

Each of the pumps 16 and 18 is used to transfer seawater from the interior 52 of the payload module 10 or the ambient ocean environment into the inflatable grippers 12. For space considerations, the pumps 16 and 18 are located at the closed end of the container 50. In operation, the pumps 16 and 18 draws seawater from inside or outside the payload module 10 and transfer it behind the grippers 12 by the use of an annular water flow passage 24 formed between the container 50 and the wall 20 of the payload module or the grippers 12 are filled through a network of piping. From the annular passage 24, the seawater or alternate fluid fills the individual grippers 12.

Figure 7:
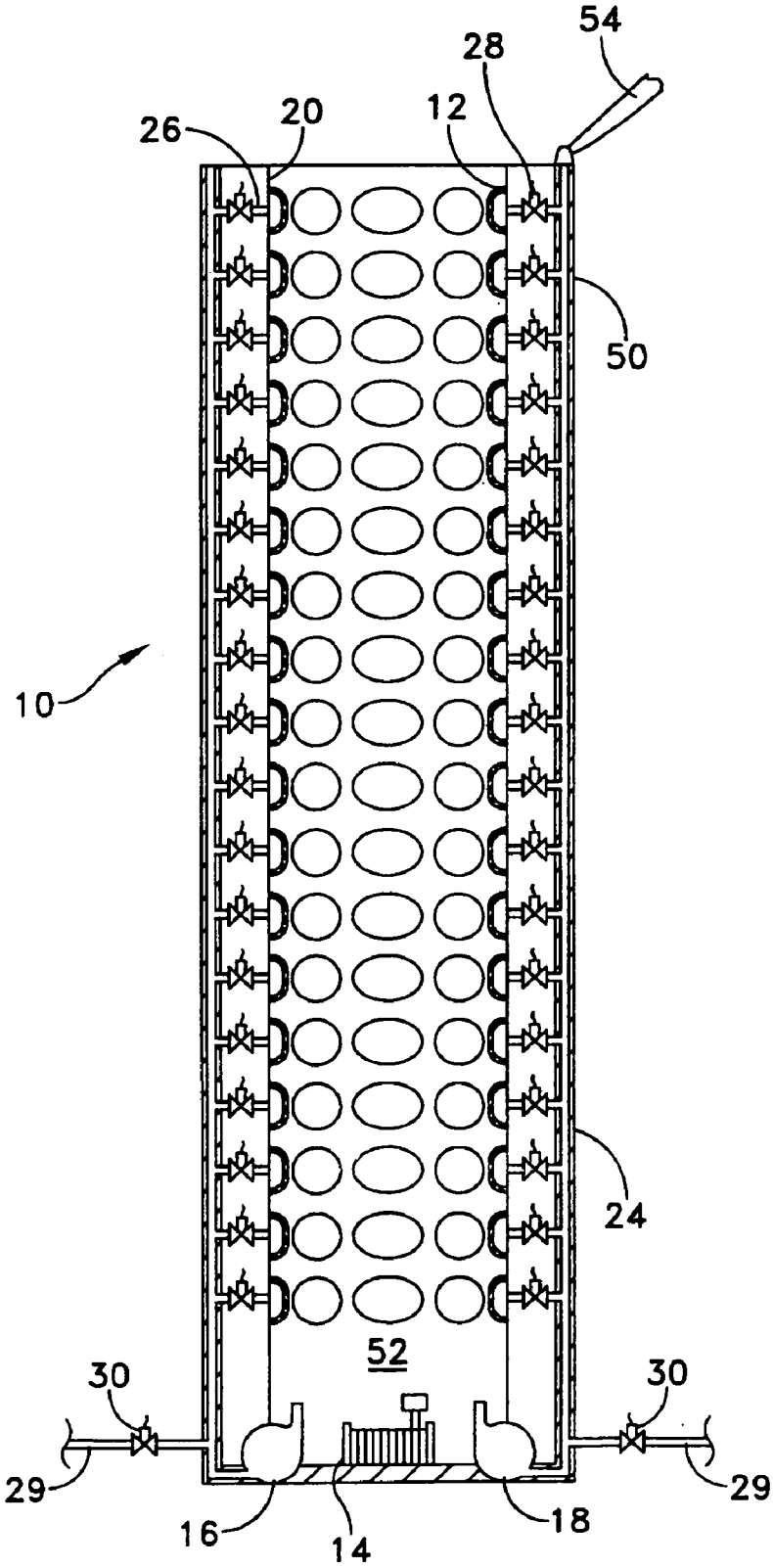
FIG. 7 depicts a cross-sectional view of a payload module of the present invention in which the flexible grippers are controllably supplied to individual grippers.

As shown in FIG. 7, individual tubing 26 with associated control valves 28 can be used to control the inflation of specific grippers 12. Inflation of specific grippers 12 allows access to certain areas in the interior 52 or can protect certain parts of the payload 40 from damage by the grippers 12 or can protect the grippers themselves. The pumps 16, 18 can be used to deflate the grippers 12, if a reversible pump is used; otherwise, the two submersible pumps (or one if cross-connected) are used to inflate and deflate the grippers.

The grippers 12 can be inflated within a wet or dry interior of the payload module 10. If the interior 52 is wet, the grippers 12 can be filled by the pumps 16, 18 from a supply of seawater from the interior. If the interior of the payload module 10 is dry, the grippers 12 can be filled by the pumps 16, 18 from water within the annular passage 24 and/or outside of the container 50 by use of external connection 29 with control valve 30 (shown in FIG. 7 but also adaptable for the payload module of FIG. 1).

Once the grippers 12 are inflated, the pumps 16 and 18 can then be used to empty remaining seawater from the container 50 by use of the external connection 29. In this way, the grippers 12 remain filled with seawater while the contents of the container 50 can remain dry. To achieve this, a muzzle hatch 54 (shown partially due to space restrictions) on the container 50 must be closed or the submarine must be surfaced before the process to pump the interior of the payload module 10 can begin. If surfaced, the muzzle hatch 54 would remain open so air could flow in as seawater was being pumped out. If submerged, the muzzle hatch 54 must be closed and air must be pumped in as the seawater is being pumped out.

The discharge pressure of the pumps 16 and 18 controls the grip force of the grippers 12. As the pressure is increased; the grip force increases. The pressure supplied to the grippers 12 should correspond to the weight and strength of the payload 40 being contained in order to prevent accidental damage to the payload.

The grippers 12 are made from a flexible material, such as a fabric, that is waterproof, puncture-resistant, tear-resistant and sufficiently strong to withstand the inflation pressure and a small portion of the weight of the payload 40. The flexible material is preferably Kevlar for more tear resistance or elastomeric rubber for more flexibility. For each gripper 12, the grippers are preferably fastened to the inner wall 20 (by means known to those skilled in the art) over individual apertures in the inner wall.

The winch 14 is used to assist with loading and unloading of the payload 40 of the payload module 10. The cable of the winch 14 shall be long enough to reach well outside the payload module. Since most payload items are buoyant in nature, the winch 14 is needed to pull the payload 40 down into the payload module 10. The winch 14 may also be used to control the rate of ascent as a particular payload item is allowed to float out.

The main advantage of the payload module 10 is that it provides a flexible means of carrying almost anything inside a submarine or submersible vehicle. The fluid nature of seawater in combination with the flexible material of each gripper 12, allows the grippers to match the shape of the payload 40 where the grippers make contact. Because all the grippers 12 are interconnected by the fluid action of the seawater, the grippers conform to the shape of the payload 40 as a group. Therefore, individually then cumulatively as a group, the grippers 12 flow around and conform to the shape of the payload 40.

Regardless of the shape or size of the payload 40, the pumps 16 and 18 can continue pumping until all the grippers 12 are either engaged with the payload or completely inflated. If no payload is present, the pumps 16 and 18 would operate for the longest period because it must fully inflate all of the grippers 12 (unless flow is controlled to individual grippers as depicted in FIG. 7). Once the desired pressure is reached, the grippers 12 will be either fully engaged or fully inflated. The pumps 16 and 18 can then be controlled to shut off automatically.

The payload module 10 is depth independent. The hydrostatic depth pressure is balanced across the suction and discharge sides of the submersible pumps 16, 18. Since seawater is incompressible, the hydrostatic depth pressure is constantly sensed across the fabric of the gripper 12. From there it is transferred to the discharge side of the submersible pumps 16, 18. Therefore, the payload module 10 can operate equally well at any depth.

By controlling the shut-off pressure on the submersible pumps 16 and 18, the grip strength of the grippers 12 can also be controlled. As the shut-off pressure is increased, so is the grip force. If the payload 40 is heavy and strong, a heavy grip force can be applied. If however, the payload 40 is light and fragile, a light grip force can be applied. This is simply controlled by controlling the pressure supplied by the pumps 16 and 18.

Because the grippers 12 are made from a flexible material, a uniform pressure force is applied to the payload 40. Doing so greatly increases the holding strength of the grippers 12 and greatly reduces the chance of damaging the payload 40. If the same grip force was concentrated at a point or a small area, the payload 40 could be damaged. The uniform pressure distribution of the system therefore minimizes any risk of damaging the payload 40.

The flexible payload module 10 can be used to store the payload 40 dry or wet. In both cases, the grippers 12 are filled with seawater, but the interior 52 itself can be wet or dry. If a dry bay is desired, after the payload 40 is loaded wet, the seawater is pumped out once the grippers 12 are inflated.

If the payload 40 must be loaded dry, the submarine is surfaced and the payload module 10 is emptied of seawater. Seawater is then supplied from external sources to the external connection 29 to inflate the grippers 12. In this way, the payload 40 only comes in contact with the dry side of the grippers 12.

The flexible payload module 10 provides for shock protection since none of the grippers 12 are rigid; therefore, shock loads are easily absorbed. Each inflatable gripper 12 only opposes another gripper when they are inflated. If the payload 40 shifts and moves from its balanced center position during a shock event, seawater is simply transferred from one gripper 12 to another gripper. Once the shock event ends, the grippers 12 redistribute the seawater within them until the entire system is returned to a balanced condition with the payload 40 centered again in the interior 52.

The gripper 12 are preferably conical when filled; however, they can be any shape. The grippers 12 must merely be watertight such that they can be inflated and deflated with water or other fluids. The grippers 12 can also be used with air instead of water, only requiring compressors to replace the pumps 16 and 18.

Figure 8:
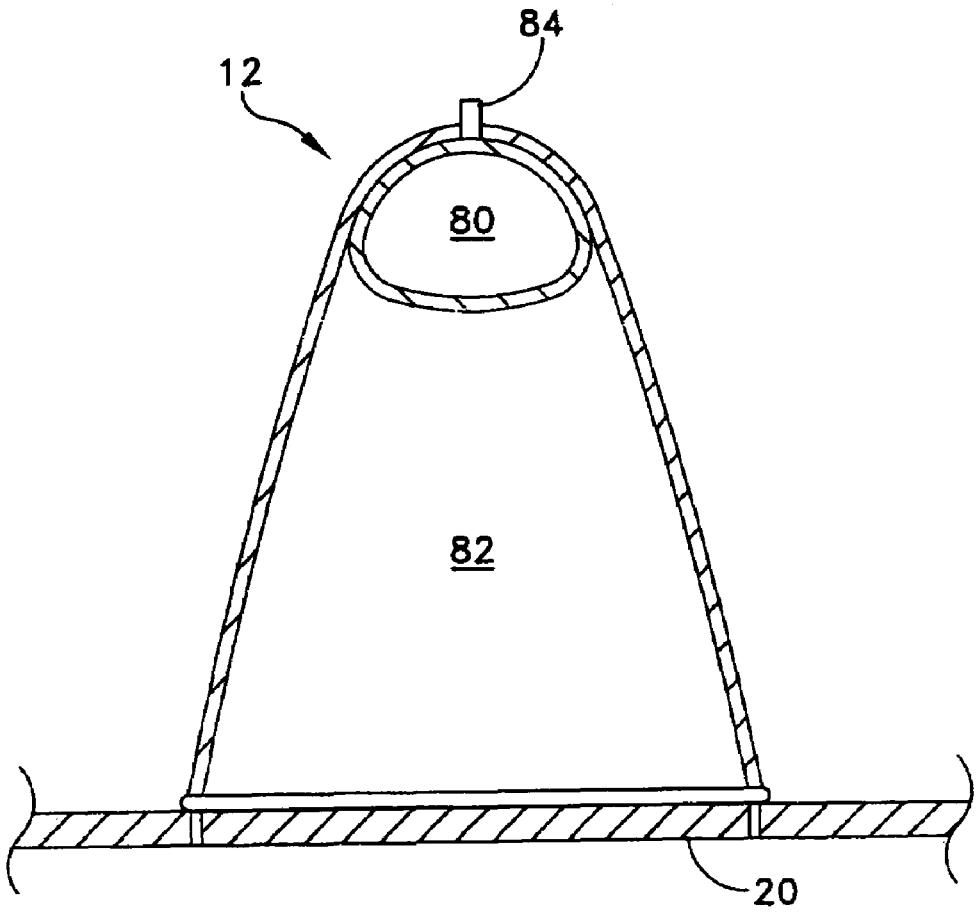
FIG. 8 depicts a cross-sectional view of a bi-furcated gripper.

In an alternate configuration, shown in FIG. 8, the gripper 12 can also be inflated using a mixture of seawater and air or a mixture of any other fluid. For this configuration, the gripper 12 is compartmented to provide for non-linear stiffness. In the non-exclusive configuration of the gripper 12 of the figure, an air compartment 80 is adjacent to a seawater compartment 82 in the gripper. The air compartment 80 is preferably pre-filled prior to the addition of the payload 40 to the module 10 by a connection 84.

During use of the bi-furcated configuration of air and fluid, the tip of the gripper 12 can be soft and the base can be comparatively stiffer. The soft portion would be a benefit when in contact with a delicate payload and the stiffer portion would be a benefit for a large and robust payload.

The pumps 16 and 18 do not have to be submersible. The pumps can be located separately inside the submarine pressure hull. The pumps 16 and 18 must merely be able to pump seawater into and out of the individual grippers 12, and into and out of the interior 52 of the payload module 10.

Figure 9:
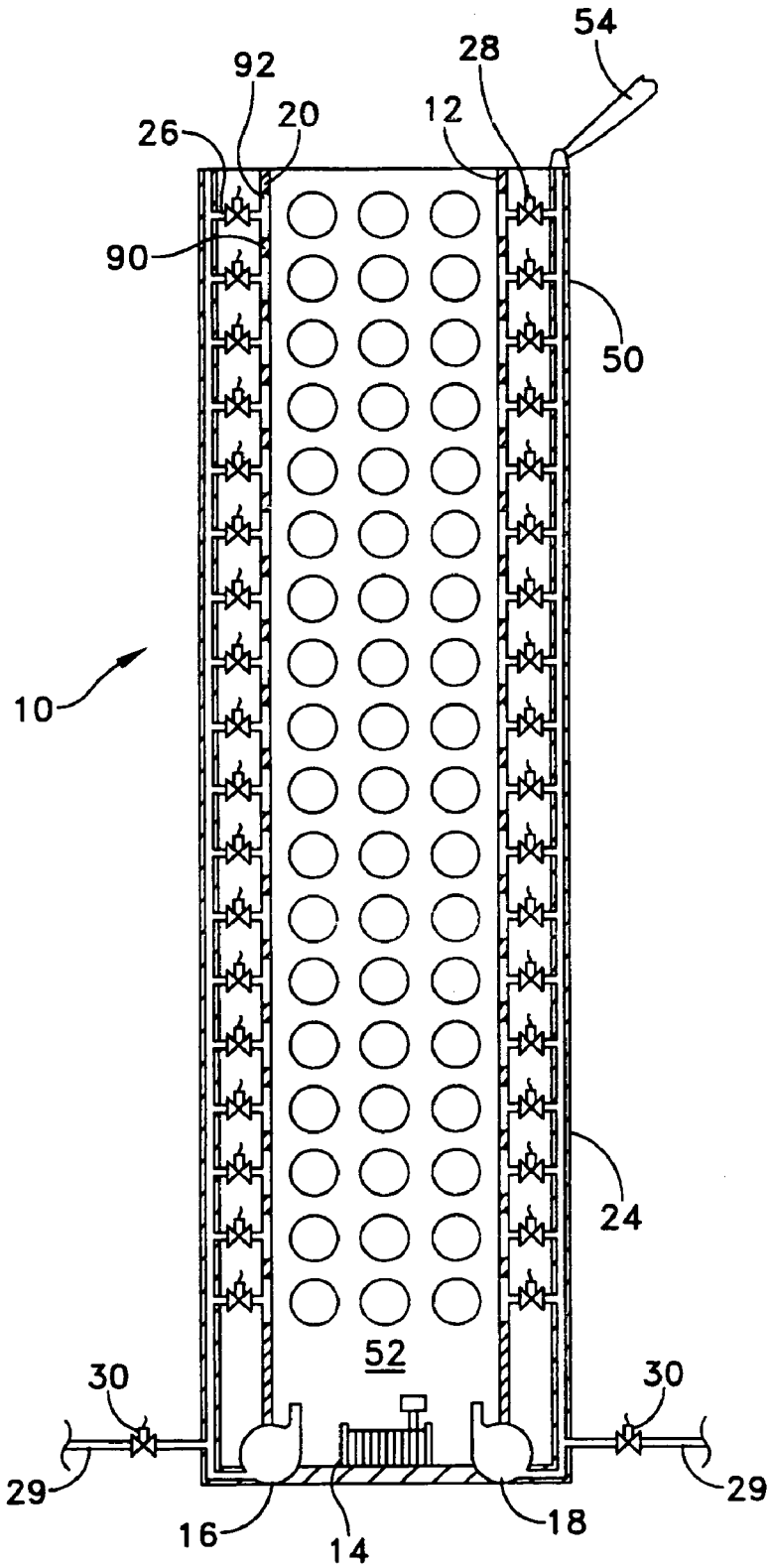
FIG. 9 depicts a cross-sectional view of a payload module of the present invention in which the flexible grippers are controllably supplied to individual grippers with the individual grippers passing through an inner skirt.

In yet another configuration shown in FIG. 9, an inner cylindrical skirt 90 can be positioned on the inner cylindrical wall 20 to provide a smooth surface for loading and unloading. Without the inner skirt 90, the payload 40 may get hung up on the protruding grippers 12. Apertures 92 are placed in the inner skirt 90 that are equal in diameter and in-line with the grippers 12. When deflated, the grippers 12 are contained within the inner skirt 90. When inflated, the grippers 12 expand and pass through the inner skirt 90. The inner skirt 90 provides a cavity or well that is large enough to contain a deflated gripper. This configuration creates a smooth surface for the payload 40 to slide past when the payload is being loaded and unloaded.

Obviously many modifications and variations of the present invention may become apparent in light of the above teachings. In light of the above, it is therefore understood that within the scope of the appended claims, the invention may be practiced otherwise than as specifically described.

What is claimed is:

1. A module for holding a payload in position, said module comprising:

a plurality of grippers, each individual gripper fillable to a conical shape from an interior wall of said module to a longitudinal axis of said module wherein each of said grippers is positioned to be in contact with a surface of the payload by an extending action resulting from fluid supplied to and filling each individual gripper with the contact acting to secure the payload;

a passageway fluidly connected to supply fluid to said plurality of grippers and to each of said grippers and to remove the fluid from each of said grippers when releasing the payload; and an inner skirt positioned on said interior wall toward the longitudinal axis of said module wherein said inner skirt includes a plurality of apertures wherein each of said apertures is sized to secure one of said grippers as the fluid is removed from each of said grippers such that an inner surface of said inner skirt extends to the longitudinal axis beyond each of said grippers with the fluid removed.

2. A module for holding a payload in position, said module comprising:

a plurality of grippers, each individual gripper fillable to a conical shape from an interior wall of said module to a longitudinal axis of said module wherein each of said grippers is positioned to be in contact with a surface of the payload by an extending action resulting from fluid supplied to and filling each individual gripper with the contact acting to secure the payload;

a passageway fluidly connected to supply fluid to said plurality of grippers and to each of said grippers and to remove the fluid from each of said grippers when releasing the payload, said passageway including a plurality of branch tubing wherein each tube of said plurality of branch tubing is fluidly connected with said individual gripper of said plurality of grippers and a plurality of valves wherein each valve of said plurality of valves acts to control the amount of the fluid supplied to said individual gripper; and an inner skirt positioned on said interior wall toward the longitudinal axis of said module wherein said inner skirt includes a plurality of apertures wherein each of said apertures is sized to secure one of said grippers as the fluid is removed from each of said grippers such that an inner surface of said inner skirt extends to the longitudinal axis beyond each of said grippers with the fluid removed.

* * * * *